US006062112A

United States Patent [19]

Bonniot

[11] Patent Number: 6,062,112

[45] Date of Patent: May 16, 2000

[54] COUPLING DEVICE AND ROTARY DRIVE TOOL THEREFOR

[75] Inventor: Franck Bonniot, Pougues les Eaux, France

[73] Assignee: FACOM, Morangis Cedex, France

[21] Appl. No.: 09/068,096

[22] PCT Filed: Nov. 12, 1996

[86] PCT No.: PCT/FR96/01783

§ 371 Date: May 1, 1998

§ 102(e) Date: May 1, 1998

[87] PCT Pub. No.: WO97/18061

PCT Pub. Date: May 22, 1997

[30] Foreign Application Priority Data

Nov. 14, 1995 [FR] France ..... 95 13 485

[51] Int. Cl.[7] ..... B25B 13/00

[52] U.S. Cl. ..... 81/177.85; 81/177.2; 403/328

[58] Field of Search ..... 81/177.85, 177.2; 403/322.2, 322.3, 327, 328

[56] References Cited

U.S. PATENT DOCUMENTS

| | | | |
|---|---|---|---|
| 4,571,113 | 2/1986 | Coren | 81/177.85 X |
| 4,721,022 | 1/1988 | Batten . | |
| 4,848,196 | 7/1989 | Roberts | 81/177.85 |
| 4,988,248 | 1/1991 | Flux | 403/328 X |
| 5,090,275 | 2/1992 | McCann . | |
| 5,291,809 | 3/1994 | Fox, III et al. . | |
| 5,390,571 | 2/1995 | Fox et al. | 81/177.85 |
| 5,433,548 | 7/1995 | Roberts et al. . | |
| 5,531,140 | 7/1996 | Chow | 81/177.85 |

FOREIGN PATENT DOCUMENTS

| | | |
|---|---|---|
| 0 053 215 | 6/1982 | European Pat. Off. . |
| 42 07 605 | 9/1993 | Germany . |
| 2 175 665 | 3/1986 | United Kingdom . |

*Primary Examiner*—James G. Smith

*Attorney, Agent, or Firm*—Wenderoth, Lind & Ponack, L.L.P.

[57] ABSTRACT

A coupling device in which locking and unlocking is controlled by an axial rod (T) sliding in a central bore (A) formed in a male portion (1). The movement of the rod is controlled by a pivoting member (15). The device is particularly suitable for coupling extensions to sockets.

25 Claims, 7 Drawing Sheets

COUPLING DEVICE AND ROTARY DRIVE TOOL THEREFOR

FIELD OF THE INVENTION

The present invention relates to a device for coupling part of a male component to part of a female component which is equipped with a locking recess.

The present invention applies in particular to the coupling between an extension bar or a universal joint of a rotational-drive tool, for example a ratchet wrench, and another extension bar, an interchangeable socket or a universal joint for screwing/unscrewing.

DESCRIPTION OF THE RELATED ART

In known coupling devices of the above type (see, for example, U.S. Pat. No. 1,864,466), the actuator is a ring mounted so that it can slide on the male component and is connected directly to the transmission means, which consists of a central rod, by a transverse pin. In order to allow the transmission of forces as well as movement, the pin passes through a diametral slot in the male component. The slot has to be long enough and wide enough to accommodate the pin, and this considerably weakens the male component.

SUMMARY OF THE INVENTION

The object of the present invention is to provide a coupling device which is more robust than the known devices, while at the same time being reliable, comfortable to manipulate and not very sensitive to soiling.

Another object of the present invention is to provide a tool for driving in rotation, especially a rigid or flexible extension bar, universal joint, cranked, sliding or articulated handle, comprising a part of a male component. The distal end part of the tool is intended to fit into a part of a female component of a driving member, especially a socket, a universal joint or a rigid or flexible extension bar, equipped with a locking recess, the part of the male component comprising a coupling device as defined above.

BRIEF DESCRIPTION OF THE DRAWINGS

Several embodiments of the invention will now be described with reference to the appended drawings, in which.

DETAILED DESCRIPTION OF THE INVENTION

Figure 1:
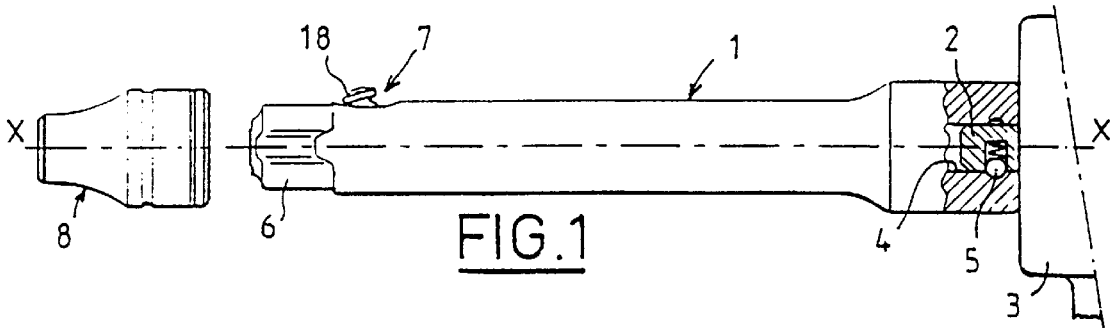
FIG. 1 depicts, in part sectional view, an extension bar in accordance with the present invention, associated with a socket and with a rotational-drive tool.
Figure 2:
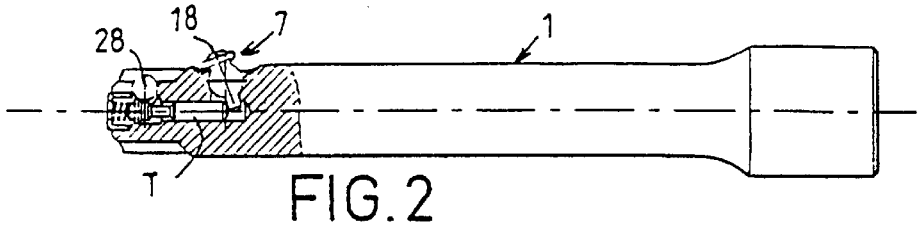
FIG. 2 depicts the extension bar shown in FIG. 1, with a distal end part thereof in section.

FIGS. 1 and 2 show an extension bar 1 which has an overall shape of a straight bar having an axis X—X, and is assumed to be horizontal for the convenience of the description. This extension bar is intended to interact, via its proximal or rear end (to the right in FIGS. 1 and 2) with an end adapter 2 of a rotational-drive tool 3 which is, for example, a ratchet wrench. In particular, the end adapter 2 may be a standardized square which is accommodated in a matching axial orifice 4 in the extension bar. A spring-loaded ball 5, belonging to the end adapter, then snaps into a corresponding recess provided in the orifice 4.

At its distal or front end (to the left in FIG. 1), the extension bar has a non-circular male coupling profile 6 and is fitted with a coupling or locking device 7. The profile 6 is designed to fit into a matching female profile provided in the proximal end of an interchangeable socket 8. The distal end of the latter has a driving profile designed to interact with the head of a member to be rotatably driven, which is typically a screw or a nut.

The locking device 7 (FIGS. 3 and 4) is constructed as follows.

A blind stepped central bore A is formed along the axis X—X from the distal end of the extension bar. The bore comprises, in turn, an entry part 9 having a relatively large diameter, an intermediate part 10 having a medium or intermediate diameter, and a main part 11 having a relatively small diameter. The main part 11 has the greatest length, and ends beyond part 6 of the extension bar.

The first radial passage 12 connects the intermediate part 10 of the bore A to the outer peripheral surface of the extension bar. The first radial passage opens out into a hollow region of the profile 6. The external opening of passage 12 is narrowed. A second radial passage 13, coplanar with the passage 12 and lying on the same side of the axis X—X, connects part 11 of the central bore, close to its proximal end, to the outer peripheral surface of the extension bar. The passage 13 is counterbored over more or less half its length, and this defines an internal shoulder 14.

An actuator 15 is mounted so that it can pivot in the passage 13. The actuator 15 comprises a spherical ball joint 16 held between the shoulder 14 and an external crimped ring 17 formed at the entry to the passage. The ball joint 16 includes outwardly extending operating knob 18, which projects beyond the external surface of the extension bar. A shank 19 extends inwardly from knob 18 so that it penetrates part 11 of the central bore. The diameter of the shank 19 is slightly smaller than that of part 11 of the central bore.

A central transmission rod T is accommodated in the bore A. The transmission rod includes a main body 20, sliding in bore part 11, a small-diameter unlocking portion 21 having a first frustoconical cam 22 which widens towards the front of the extension bar, a locking portion 23 having an intermediate diameter, a second frustoconical cam 24 which also widens towards the front of the extension bar, and an axial stud 25 having a relatively small diameter.

A cup 26 is fixed in the entry part 9 of the bore, and a return spring 27 is compressed between the closed end of the cup and the front end of the rod T, so that the stud 25 ensures that the spring remains centrally disposed.

A locking ball 28 is housed with a small amount of clearance in the passage 12 and is held therein by the aforementioned narrowing of the passage 12.

At rest (FIG. 3), under the action of spring 27 and of cams 22 and 24, the ball 28 is kept in the outward position, in which it protrudes from the extension bar. It is then in contact with the front end of the cam 24. The rear end of the transmission rod T then lies more or less in line with the axis of the passage 13, and this causes the shank 19 to be pushed in a backward direction. The knob 18 is therefore pivoted forward, as depicted.

In order to be able to insert the extension bar into the socket 8, it is first of all necessary to allow the ball 28 to retract into the passage 12. For this, the operator pulls the knob 18 towards himself (arrow F in FIG. 4), so that the shank 19 pushes forwardly on the end section of the rod T, compressing the spring 27. This movement aligns the unlocking portion 21 with the passage 12 (FIG. 4), and this allows the ball to fully retract.

Figure 3:
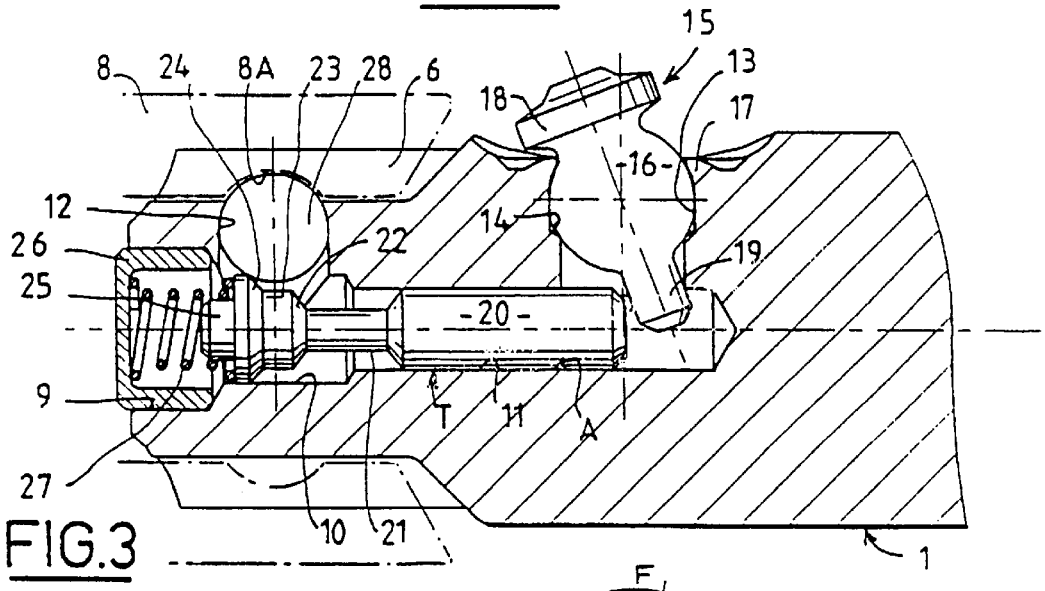
FIG. 3 depicts, in a longitudinal sectional view and on a larger scale, the distal end of the extension bar, with the coupling device in an at-rest or a locking position.

When the part 6 of the extension bar has entered the socket by a predetermined distance and reaches an appropriate stopping point, a recess 8A, for example consisting of a torus-shaped groove, as depicted in chain line in FIG. 3, opposes the passage 12. By releasing the knob 18, the spring 27 is then allowed to return the central rod T to its initial position, which causes the ball 28 to re-emerge due to the action of cam 22, then cam 24. The ball therefore becomes housed in recess 8A of the socket. The coupling is therefore locked.

It should be noted that, because of the small difference in diameter between the shank 19 and the part 11 of the bore, the actuator 15 is more or less guided laterally, which means that movement of the actuator is practically limited to a back and forth rocking movement in the common plane of the passages 12 and 13.

Furthermore, variations in radial clearance between the socket and the extension bar, and variations in the depth of the recess 8A, are automatically compensated for due to the presence of the cam 24 and the spring 27, which constantly and elastically urge the ball radially outward. The locking position of the device 7 is therefore practically identical to its at-rest position.

The embodiment of FIGS. 5 to 7 differs from the previous embodiment in the following respects:

- the central bore A has a constant diameter along its entire length and extends markedly beyond the passage 13;
- the transmission rod T comprises, in turn, from front to back: a short guiding portion 29 having the same diameter as the central bore; the unlocking portion 21 having a relatively small diameter; the frustoconical cam 22 which widens in a direction towards the back; the locking portion 23 of medium diameter; the frustoconical cam 24 which also widens towards the back; the body 20 having the same diameter as the bore, in which a groove 30 is formed close to the rear end of the body 20; and the stud 25 which keeps the return spring 27 in a central position, and the spring which is compressed between the rear part of the rod and a closed end of the bore;
- the shank 19 of the actuator is forked and is accommodated in the groove 30, the shank straddles the small-diameter portion 31 of the rod which is delimited by the groove.

The result of this arrangement is that in the at-rest or locking position (FIG. 5), the transmission rod is pushed forward by the spring 27, and this jams the ball 28 between the narrowed opening of the passage 12 and the top of the cam 24. The stem 19 is therefore pushed forward by the rear wall of the groove 30, which means that the knob 18 is pivoted in the backward direction.

To allow the ball 28 to be retracted, the operator pushes the knob 18 forward, so that the shank 19 of the actuator pulls the central rod backwards, thereby compressing the spring 27. Locking is obtained in the same way as before, simply by releasing the knob 18.

It should be noted that the lateral guidance of the actuator is obtained, in this embodiment, due to the forked shape of the stem 19.

Figure 4:
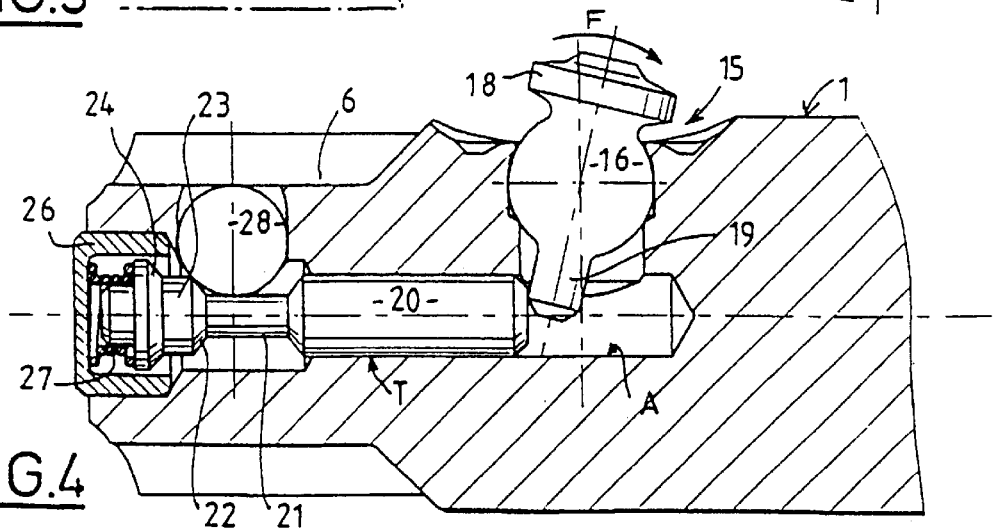
FIG. 4 is a view similar to FIG. 3, but with the coupling device in the unlocked position.

The embodiment of FIGS. 8 to 10 differs from the previous embodiment in the following respects:

- the groove 30 is replaced by a bi-conical orifice 32, in the shape of a spinning top, and having an axis which is parallel to the axis of the passage 13;
- the shank 19 is, as shown in FIGS. 3 and 4, a cylindrical stud, and it penetrates the orifice 32 beyond the central axis X—X of the central bore;
- the knob 18 is replaced by another cylindrical stud 33;
- the stud 33 is accommodated in a recess 34 of an operating slider 35 having the form of a sector of a cylinder. The slider is held against the outer surface of the extension bar by the fact that its two lateral edges 36, of reduced thickness, slide in longitudinal grooves 37 (FIG. 9) of a sleeve 38 secured to the extension bar; and
- the ball joint 16 of the actuator does not rest against the ring 17 but is urged towards the latter by an auxiliary spring 39 which is compressed between the shoulder 14 and the ball joint. This avoids any risk of play in the actuator while at the same time allowing the latter to enjoy a wide freedom of movement.

Figure 5:
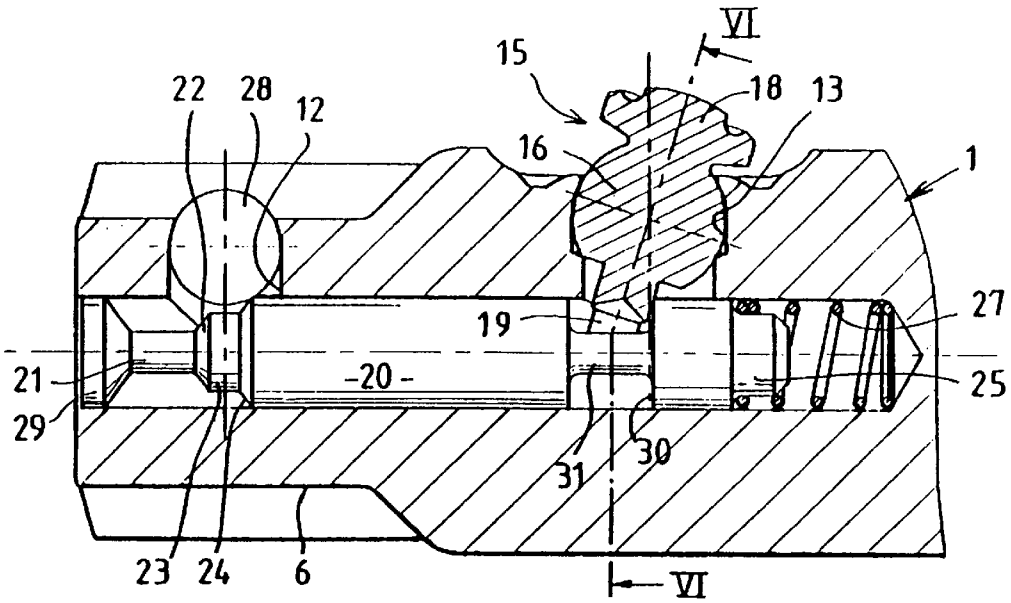
FIGS. 5 and 7 are views similar respectively to FIGS. 3 and 4, but corresponding to a second embodiment of the present invention.
Figure 6:
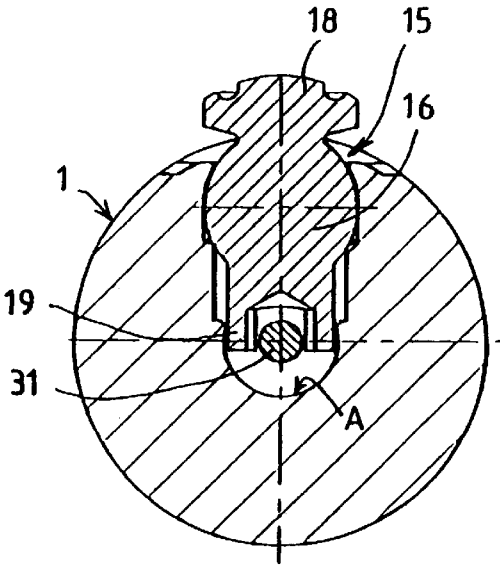
FIG. 6 is a view taken in section on line VI—VI of FIG. 5.
Figure 7:
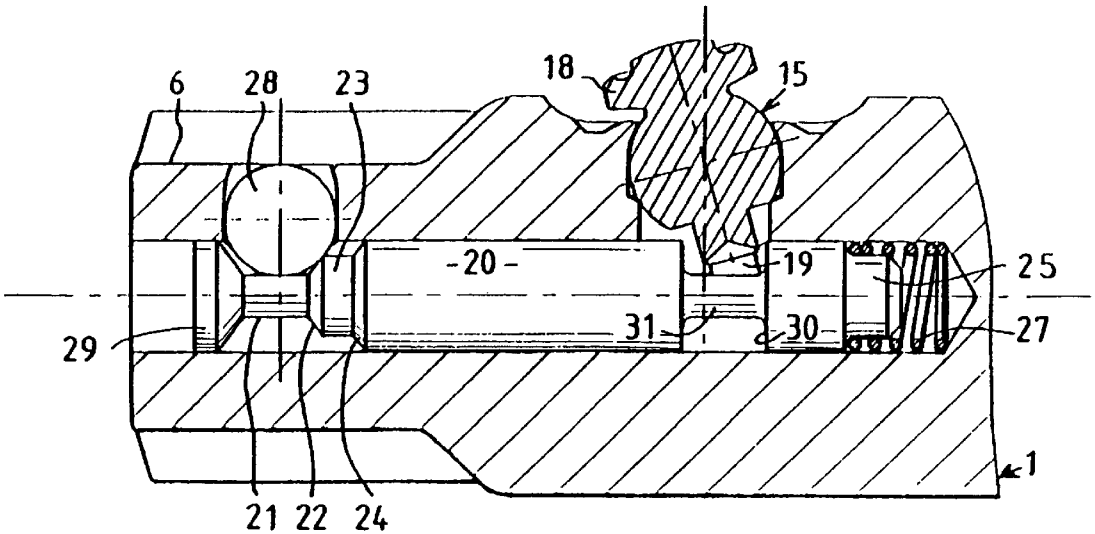
Figure 8:
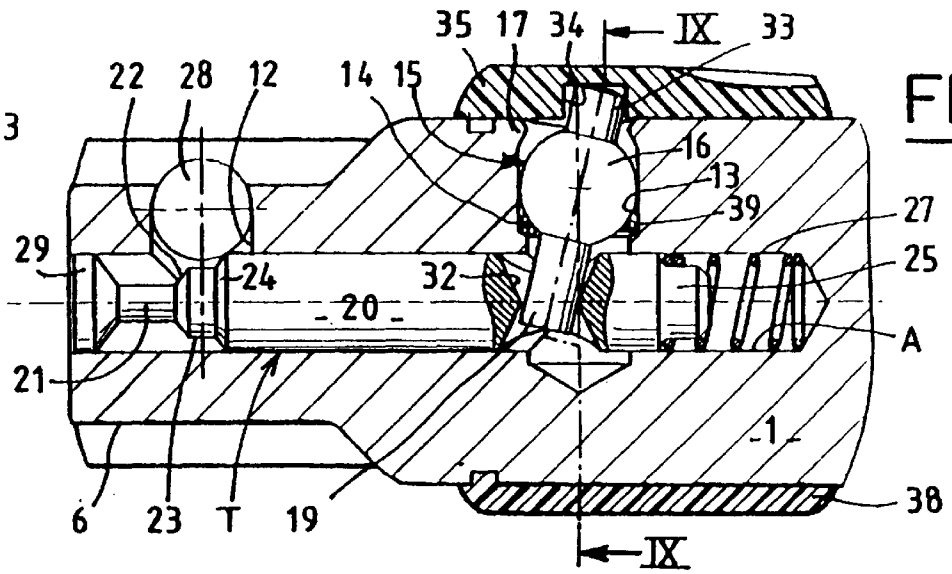
FIGS. 8 and 10 are views similar respectively to FIGS. 3 and 4, but corresponding to a third embodiment of the present invention.
Figure 10:
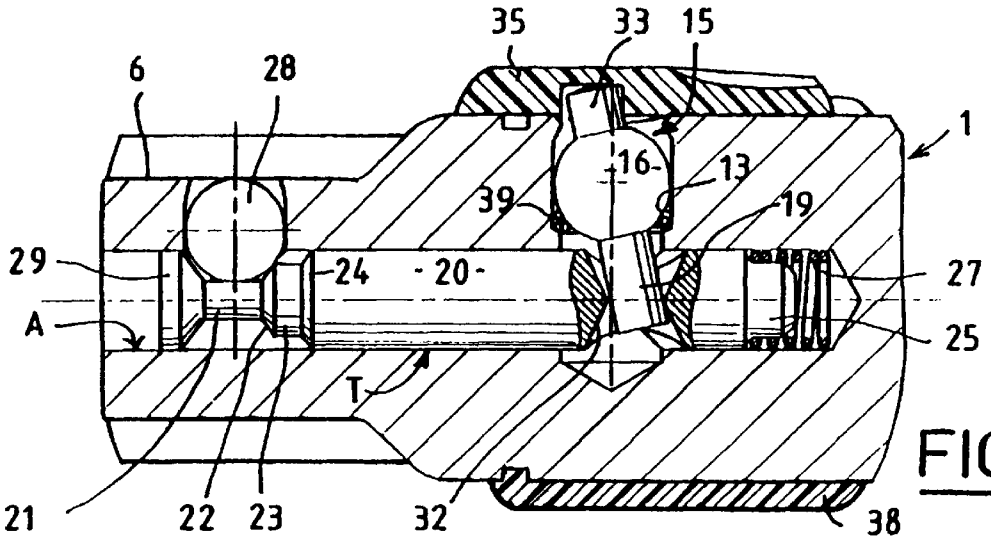
Figure 9:
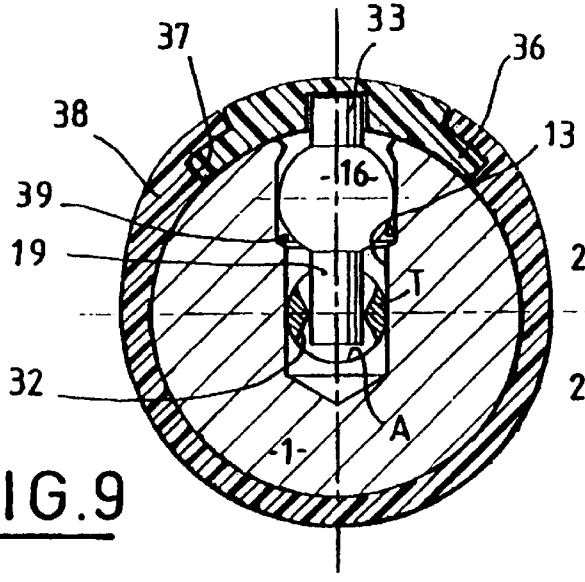
FIG. 9 is a view taken in section on line IX—IX of FIG. 8.

The operation of the embodiment of FIGS. 8–10 is the same as that of the embodiment of FIGS. 5 to 7, except that the actuator is operated indirectly, via the slider 35, which is pushed forward to retract the ball. The slider 35 makes usage more comfortable and effectively protects the internal mechanism against the ingress of dirt. Furthermore, the fixed sleeve 38 protects the slider against the risk of inadvertent actuation by surrounding components when the extension bar is pulled backward.

It should also be noted that the bi-conical orifice 32 by itself provides lateral guidance of the actuator, while at the same time making it possible to obtain an increased axial travel of the central rod and eliminating any play between the actuator and the central rod, irrespective of the direction of travel.

Figure 11:
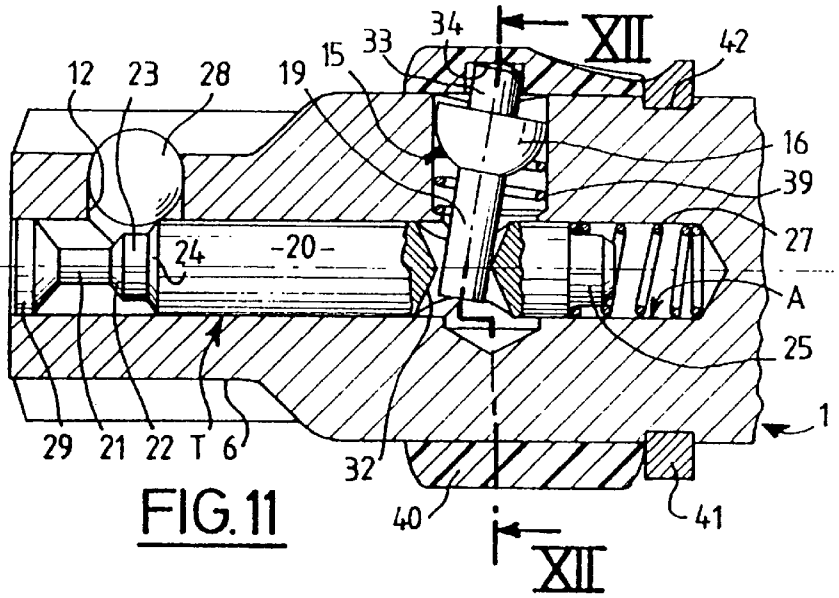
FIGS. 11 and 13 are views similar respectively to FIGS. 3 and 4, but relating to a fourth embodiment of the present invention.
Figure 12:
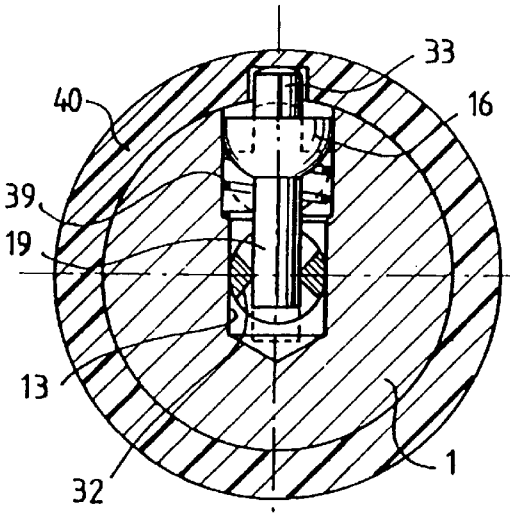
FIG. 12 is a view taken in section on line XII—XII of FIG. 11.
Figure 13:
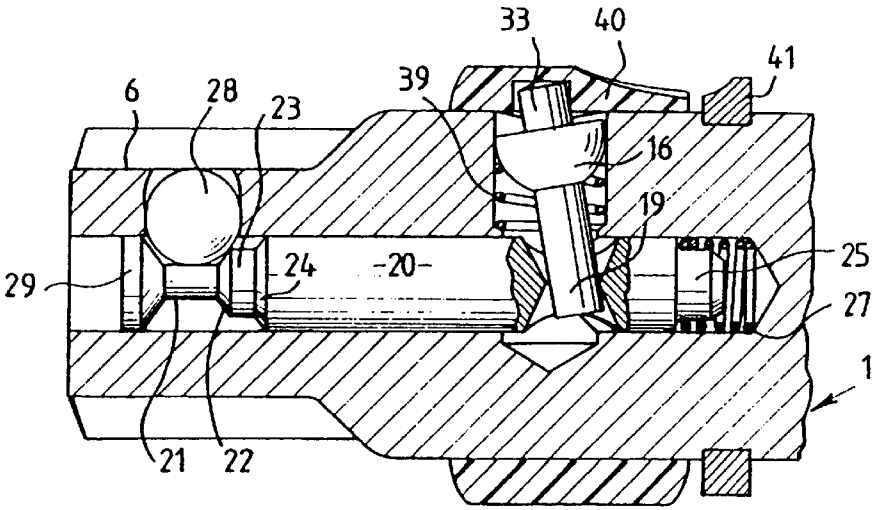

The embodiment of FIGS. 11 to 13 differs from the previous embodiment in the following respects:

- the ball joint 16 is hemispherical, its radially outer part being omitted;
- the slider 35 and sleeve 38 assembly is replaced by a sliding ring 40 which has an interior recess 34 for accommodating the stud 33; and
- a circlip 41 is accommodated in a groove 42 which is formed in the extension bar and adjacent to the rear end of the ring 40 in the at-rest and locking position, and thus the circlip protects the ring against the aforementioned risk of inadvertent actuation.

The embodiment of FIGS. 14 and 15 differs from the previous embodiment in the following respects:

- from the bearing surface 29 of the central rod to its main body 20, there are, in turn, from front to back, the cam 24, the locking portion 23, the cam 22 and the unlocking portion 21;
- the stud 25 of the central rod and the spring 27 are omitted;
- the ring 40 comprises a tubular body 43, of substantially constant thickness, which surrounds the extension bar with a large amount of clearance and is guided over it, at the front, by an internal flange 44. The internal flange 44 rests, in the at-rest and locking position, against a circlip 45 housed in a groove 46 in the extension piece, adjacent to the profile 6. The ring 40 is supported by a cylindrical annulus 47 arranged between the ring body 43 and the extension bar. The annulus at the front has a notch 48 which accommodates the stud 33 of the actuator. A return spring 49 is compressed between the rear end section of the annulus 47 and a second circlip 50 which is housed in a second groove 51 formed in the extension bar. The second circlip 50 also constitutes a means of guiding the rear end of the body 43.

Thus in the at-rest or locking position, the assembly 43–47 is pushed forward by the spring 49, so that the actuator 15 is pivoted in a forward direction. The ball can be retracted by pulling the ring body 43 in a backward direction, thus compressing the spring 49 via the annulus 47.

Note that the ring 40 is protected against any inadvertent unlocking by the socket itself which has an outside diameter at least equal to that of the ring. The circlip 45 also contributes to this protection. Furthermore, the large diameter of the return spring 49 makes the locking very reliable.

Figure 16:
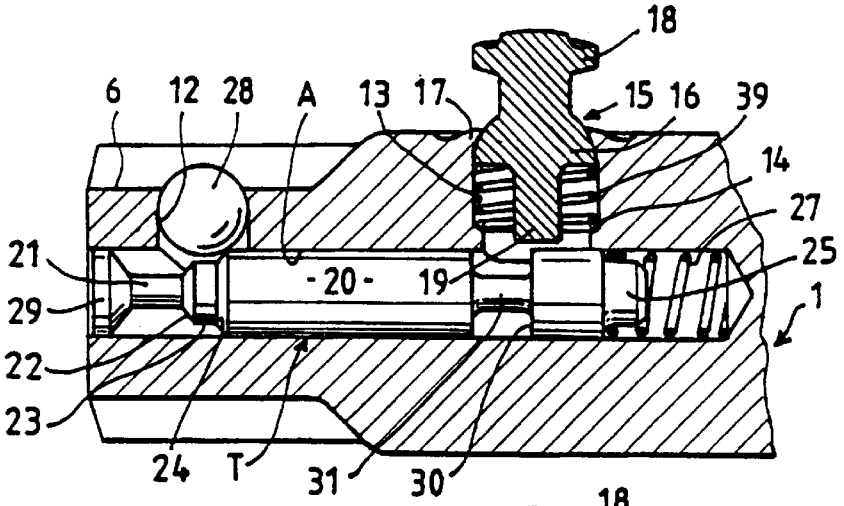
FIG. 16 is a view similar to FIG. 3 but corresponding to a sixth embodiment of the present invention.
Figure 17:
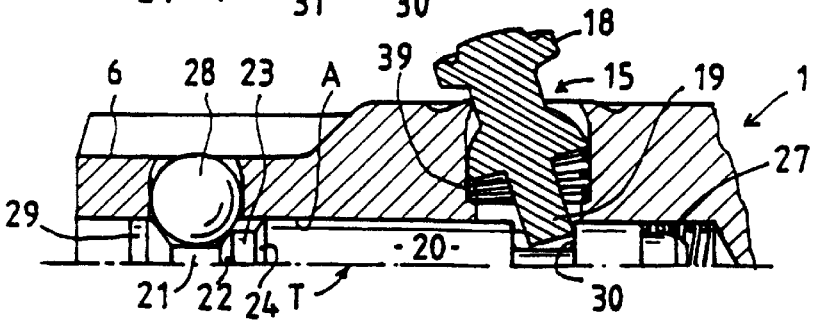
FIG. 17 is a view similar to FIG. 15 but relating to the sixth embodiment of the present invention.

The embodiment of FIGS. 16 and 17 constitutes an alternative form of the embodiment shown in FIGS. 5 to 7, from which it differs in the construction of the actuator. In this embodiment the radially inner half of the ball joint 16 is omitted and the remaining half of the ball joint is urged in an outward direction by an auxiliary spring 39.

As a result, at rest, just as in the locking position, the half ball joint rests against the crimped ring 17, and the shank 19 terminates outside of the central bore A. There is therefore no contact between shank 19 and the central rod T, which means that inadvertent pivoting of the actuator will not affect the central rod. To allow the ball to be retracted, it is necessary to pivot the knob 18 backward, then to push it in order to introduce the shank 19 into the groove 30, then pivot it forward (FIG. 17).

Figure 18:
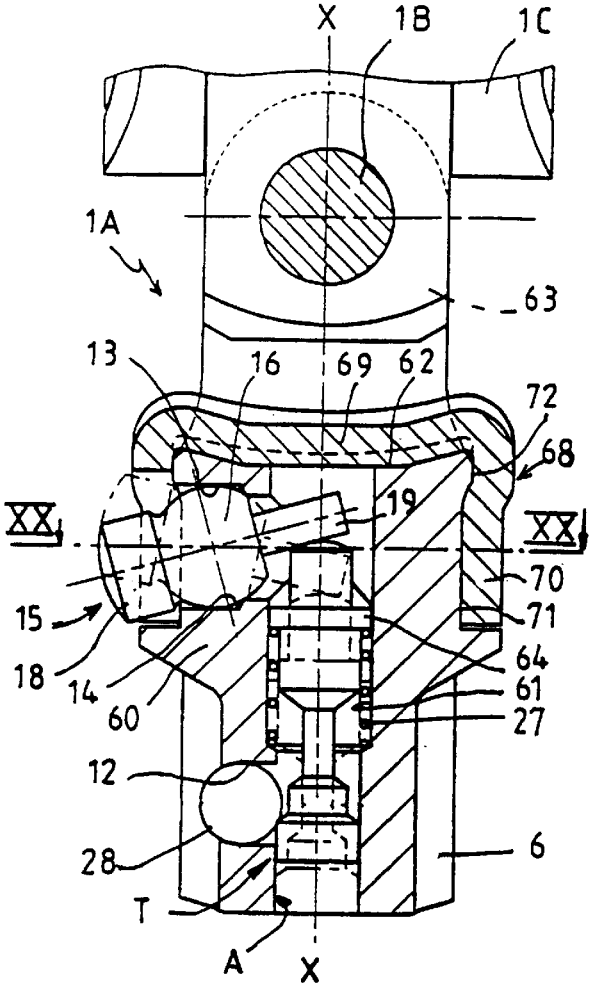
FIG. 18 is a part view in axial section of a universal joint in accordance with the present invention.
Figure 19:
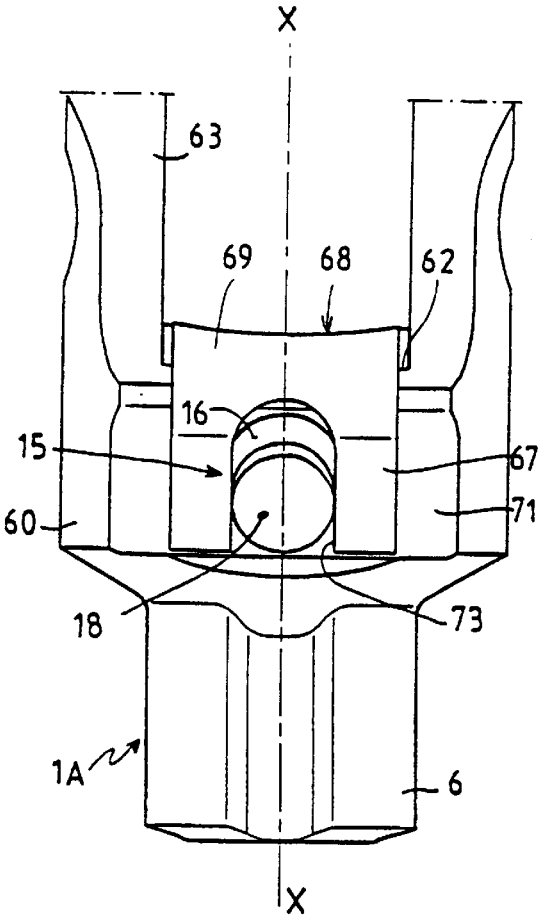
FIG. 19 is a part view taken along the direction of the arrow XIX of FIG. 18.
Figure 20:
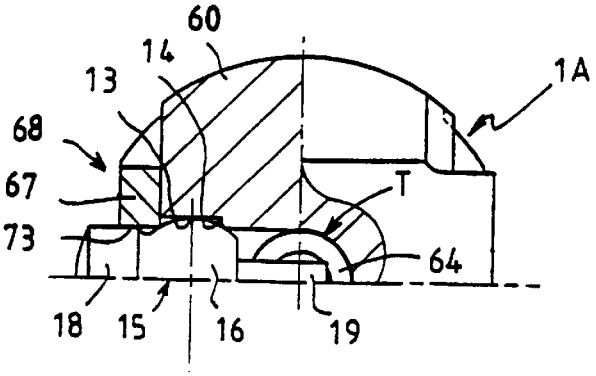
FIG. 20 is a part half view in section taken along line XX—XX of FIG. 18.

FIGS. 18 to 20 illustrate the application of the invention to a universal joint, the male part 1A of which is articulated, via a spider 1B, to the female part 1C of the universal joint.

The male part 1A comprises a body 60 which ends in the male coupling profile 6. The central bore A passes through the body and is counterbored at 61 from its proximal end as far as a short distance from the distal radial passage 12 which accommodates the ball 28. On the proximal side, the body 60 ends in a face 62 which is transverse to the axis X—X and is slightly concave and from which two lugs 63, connected to the spider lB, project.

Figure 14:
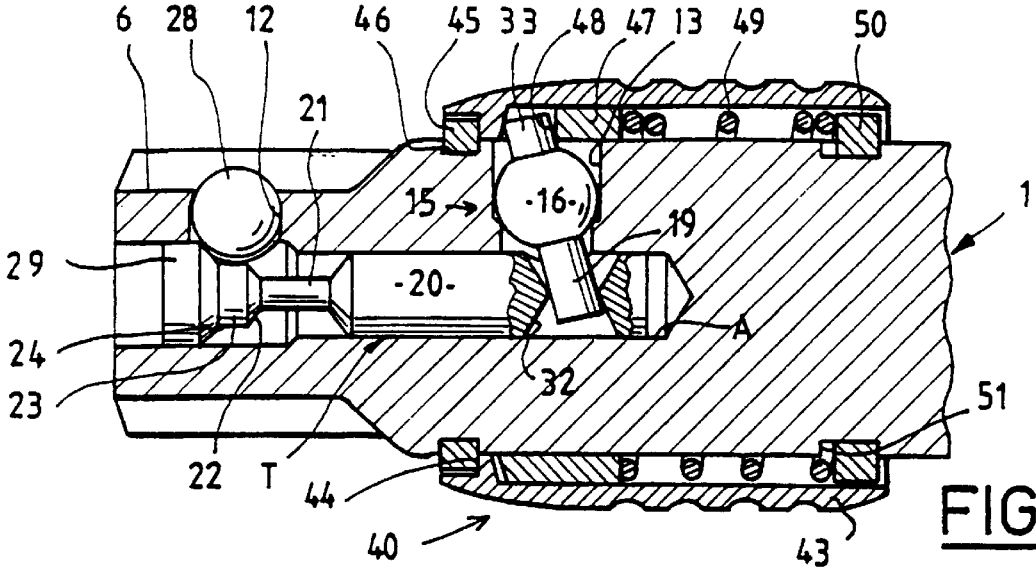
FIG. 14 is a view similar to FIG. 3 but corresponding to a fifth embodiment of the present invention.
Figure 15:
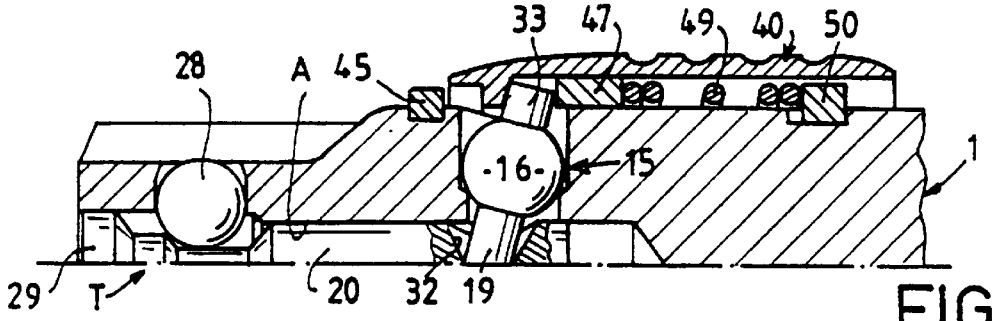
FIG. 15 is a half view similar to the upper part of FIG. 4, but relating to the fifth embodiment of the present invention.

The central rod T is similar to the one shown in FIGS. 14 and 15, except that its proximal end is solid and has an increased diameter portion 64 which slides in the counterbore 61. The return spring 27 is compressed between the increased diameter portion 64 and the shoulder at the end of the counterbore.

The rocker 15 comprises a knob 18 for direct actuation, like in FIGS. 1 to 7. The ball joint is kept against the shoulder 14 of the proximal radial passage 13 by a forked end branch 67 of a fixed stirrup piece 68 in the overall shape of a C. The web 69 of the stirrup piece matches the face 62 of the body 60 and is guided laterally between the flat internal and mutually parallel faces of the two lugs 63 which are parallel to the axis X—X. The two end branches 67 and 70 of the stirrup piece snap into opposite recesses 71 in the body 60, each being provided with an overhanging projection 72 at their proximal end.

The notch 73 in the fork 67 has a U-shape with two parallel edges and laterally guides the knob 18 which is cylindrical. Thus the rocker 15 has a single degree of freedom, that of rotation about the axis of the ball joint 16 which is perpendicular to the axis X—X.

It will be noted that such a locking device 7 involves practically no increase in the overall length of the universal joint.

Figure 21:
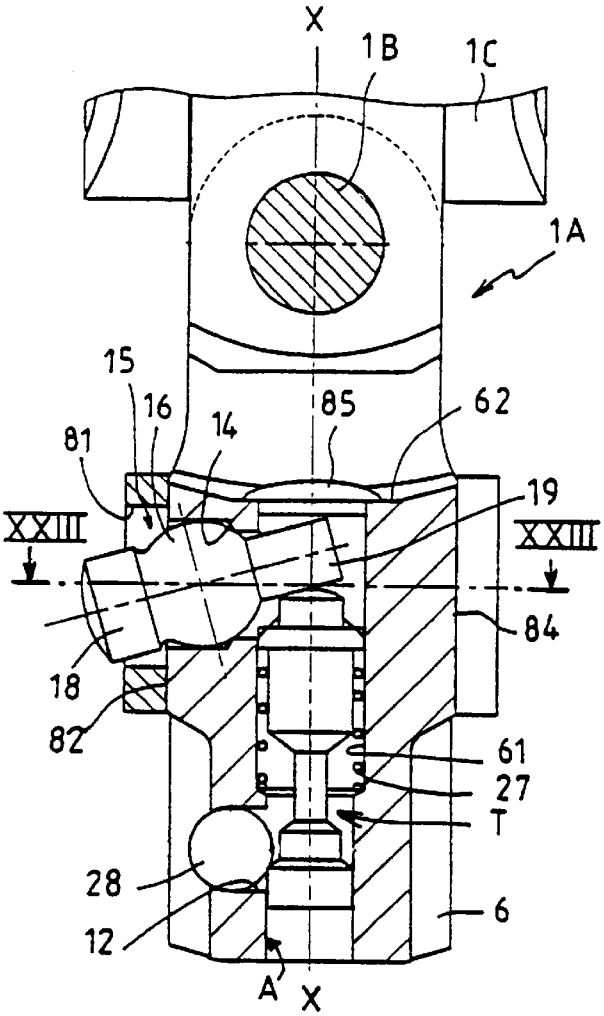
FIGS. 21 to 23 are views respectively similar to FIGS. 18 and 20, of an alternative form of the universal joint.
Figure 22:
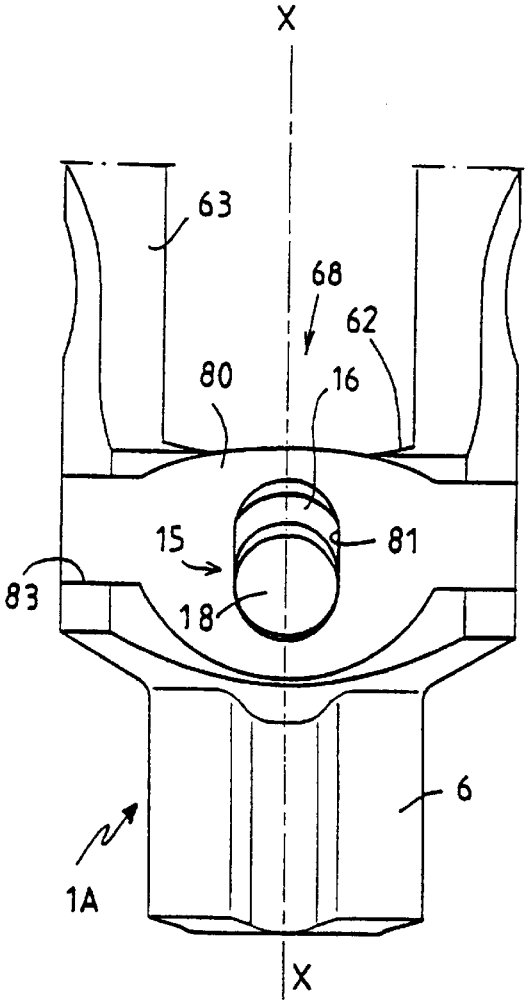
Figure 23:
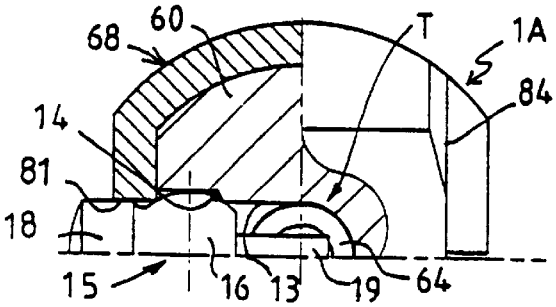

The alternative form in FIGS. 21 to 23 differs from the previous one in that the stirrup piece 68 runs around the body 60. It has a flat web 80 with an oblong hole 81 which laterally guides the cylindrical knob 18. The web 80 is pressed against a flat face 82 of the body 60. The branches of the stirrup piece are positioned by lateral recesses 83 formed in the body 60, in which recesses they are accommodated. The free ends of these branches press against a flat face 84 of the body 60, opposite the face 82. In addition, in the example depicted, a plug 85 closes the proximal end of the counterbore 61.

In all of the embodiments, the socket 8 can be replaced by any other member or tool which has a similar female part, for example a universal joint or an extension bar (rigid or flexible).

In addition, the extension bar may of course be replaced by any other member or tool which has a similar male part, in particular a universal joint, an extension bar (rigid or flexible), an articulated handle, a crank or a sliding handle.

I claim:

1. A rotary-drive tool comprising a body component having a distal end part which has a non-circular male rotational driving profile and is intended to fit into a cavity of a female component of a driving member, said body component comprising:

a) a substantially central bore extending along an axis, a distal passage and a proximal passage each extending from said central bore to an outer surface of said body component;

b) a lock disposed in the distal passage so as to be movable between a retracted position and a locking position in which said lock projects from said body component so that it can be accommodated in a locking recess of the female component;

c) a transmission device disposed in the central bore so as to movable between a locking position and an unlocking position, said transmission device having a proximal end portion and a distal end portion which interacts with said lock; and d) an actuator pivotally mounted in the proximal passage so that it can permanently and freely be moved therein by pivoting in a radial plane about an axis that is perpendicular to the axis of the central bore so as to permanently and freely interact with the proximal end portion of said transmission device so as to cause said transmission device to move in the central bore.

2. The rotary-drive tool as claimed in claim 1, wherein said actuator has an operating knob projecting from the outer surface of said body component.

3. The rotary-drive tool as claimed in claim 1, further comprising an auxiliary spring which bears against an internal shoulder formed in the proximal passage, wherein said actuator is urged toward an inactive position, which is spaced away from said transmission device, by said auxiliary spring.

4. The rotary-drive tool as claimed in claim 1, further comprising an operating member disposed so as to cover an entrance opening of the proximal passage, wherein said actuator includes an operating projection which is engaged in said operating member.

5. The rotary-drive tool as claimed in claim 4, wherein said operating member is a slider disposed on the outer surface of said body component.

6. The rotary-drive tool as claimed in claim 4, further comprising means for protecting said operating member against inadvertent actuation at least in a direction of withdrawing said distal end part of said body component from the cavity of the female component.

7. The rotary-drive tool as claimed in claim 1, wherein said actuator is positioned between an internal shoulder of the proximal passage and means for narrowing the entrance opening of the proximal passage.

8. The rotary-drive tool as claimed in claim 1, further comprising an auxiliary spring disposed in the proximal passage so as to bear against an internal shoulder formed in the proximal passage, wherein said actuator is urged toward an outer opening of the proximal passage due to the action of said auxiliary spring.

9. The rotary-drive tool as claimed in claim 1, further comprising means for laterally guiding movement of a radially inner end of said actuator.

10. The rotary-drive tool as claimed in claim 1, wherein said actuator comprises a ball joint portion, and said actuator is pivotal about said ball joint portion.

11. A rotary-drive tool comprising a body component having a distal end part which has a non-circular male rotational driving profile and is intended to fit into a cavity of a female component of a driving member, said body component comprising:

a) a substantially central bore extending along an axis, a distal passage and a proximal passage, each of said distal passage and said proximal passage extending from said central bore to an outer surface of said body component;

b) a lock disposed in the distal passage so as to be movable between a retracted position and a locking position in which said lock projects from said body component so that it can be accommodated in a locking recess of the female component;

c) a transmission device disposed in said central bore so as to movable between a locking position and an unlocking position, said transmission device having a proximal end portion and a distal end portion, which interacts with said lock; and d) an actuator mounted so that it can permanently and freely be moved along an axis of said proximal passage, in a first movement, from an inactive position to an active position in which it interacts with said proximal end portion of said transmission device, wherein said actuator, when in said active position, can be permanently and freely moved, in a second movement, essentially by pivoting in a radial plane about an axis that is perpendicular to the axis of said central bore in order to cause said transmission device to move in said central bore.

12. The rotary-drive tool as claimed in claim 11, wherein said actuator has an operating knob projecting from the outer surface of said body component.

13. The rotary-drive tool as claimed in claim 11, further comprising an auxiliary spring which bears against an internal shoulder formed in the proximal passage and urges said actuator toward an inactive position at which said actuator is spaced from said transmission device, wherein said inactive position is defined by abutment of said actuator against means for narrowing an entrance opening of the proximal passage.

14. The rotary-drive tool as claimed in claim 11, further comprising means for laterally guiding movement of a radially inner end of said actuator.

15. The rotary-drive tool as claimed in claim 11, wherein said actuator comprises a ball joint portion, and said actuator is pivotal about said ball joint portion.

16. A rotary-drive tool comprising a body component having a distal end part which has a non-circular male rotational driving profile and is intended to fit into a cavity of a female component of a driving member, said body component comprising:

a) a substantially axial central bore extending along a central axis, a distal passage and a proximal passage, each of said distal passage and said proximal passage extending from said central bore to an outer surface of said body component;

b) a lock disposed in said distal passage so as to be movable between a retracted position and a locking position in which said lock projects from said body component so that it can be accommodated in a locking recess of the female component;

c) a transmission device disposed in said central bore so as to movable between a locking position and an unlocking position, said transmission device having a proximal end portion and a distal end portion which interacts with said lock;

d) an actuator mounted in the proximal passage, said actuator having an active position along an axis of said proximal passage, said actuator, when in said active position, interacting with said proximal end portion of said transmission device, said actuator comprising a ball joint portion and a radially inner end portion extending from said ball joint portion into said central bore;

e) means for laterally guiding said radially inner end portion of said actuator when in the active position; and f) said actuator, when in said active position, being pivotable about an axis of said ball joint that is essentially perpendicular to the axis of said central bore, said pivoting movement resulting in movement of said transmission device in said central bore.

17. The rotary-drive tool as claimed in claim 16, wherein said actuator is normally maintained in the active position.

18. The rotary-drive tool as claimed in claim 16, wherein said actuator has an operating knob projecting from the outer surface of said body component.

19. The rotary-drive tool as claimed in claim 16, further comprising an auxiliary spring which bears against an internal shoulder formed in the proximal passage, wherein said actuator is urged toward an inactive position, which is spaced away from said transmission device, by said auxiliary spring.

20. The rotary-drive tool as claimed in claim 16, further comprising an operating member disposed so as to cover an entrance opening of the proximal passage, wherein said actuator has an operating projection which is engaged in said operating member.

21. The rotary-drive tool as claimed in claim 20, wherein said operating member is a slider disposed on the outer surface of said body component.

22. The rotary-drive tool as claimed in claim 20, further comprising means for protecting said operating member against inadvertent actuation at least in a direction of withdrawing said distal end part of said body component from the cavity of the female component.

23. The rotary-drive tool as claimed in claim 16, wherein said actuator is positioned between an internal shoulder of the proximal passage and means for narrowing an entrance opening of the proximal passage.

24. The rotary-drive tool as claimed in claim 16, further comprising an auxiliary spring disposed in the proximal passage so as to bear against an internal shoulder formed in the proximal passage, wherein said actuator is urged toward an outer opening of the proximal passage due to the action of said auxiliary spring.

25. The rotary-drive tool as claimed in claim 16, wherein said means for laterally guiding comprises a bi-conical opening formed in said transmission mechanism, wherein said radially inner end portion of said actuator is received in said bi-conical opening.

* * * * *